US008678890B1

(12) United States Patent
Jackson, Sr.

(10) Patent No.: US 8,678,890 B1
(45) Date of Patent: Mar. 25, 2014

(54) REMOVABLE LABEL GUEST BOOK ASSEMBLY

(76) Inventor: Dion Jackson, Sr., Oak Park, MI (US)

( * ) Notice: Subject to any disclaimer, the term of this patent is extended or adjusted under 35 U.S.C. 154(b) by 97 days.

(21) Appl. No.: 13/238,772

(22) Filed: Sep. 21, 2011

(51) Int. Cl.
*B41L 1/20* (2006.01)
*B41L 1/24* (2006.01)
*B41L 1/00* (2006.01)

(52) U.S. Cl.
USPC ..... 462/55; 462/900; 462/901; 462/63; 462/69

(58) Field of Classification Search
USPC ..... 462/900–901, 64, 69, 53, 54, 70, 55, 63
See application file for complete search history.

(56) References Cited

U.S. PATENT DOCUMENTS 3,208,771 A * 9/1965 Eberstadt y Sichel ..... 462/901
3,383,121 A * 5/1968 Singer ..... 462/69
4,029,341 A * 6/1977 Neill et al. ..... 462/901
4,277,089 A 7/1981 Lockhart
4,971,364 A * 11/1990 Templet ..... 462/901
5,090,942 A 2/1992 Traise
5,299,979 A * 4/1994 Ballard ..... 462/18
5,352,155 A * 10/1994 Fahey ..... 462/67
D418,538 S 1/2000 Fabel
6,133,195 A * 10/2000 Murphy ..... 462/18
6,135,507 A * 10/2000 Hamby et al. ..... 462/901
6,149,518 A 11/2000 Farrow
6,231,943 B1 * 5/2001 Nijboer et al. ..... 281/44
6,716,504 B2 4/2004 Song
7,294,053 B2 11/2007 Williams
7,468,115 B2 12/2008 Fox-Lovell

* cited by examiner

*Primary Examiner* — Dana Ross
*Assistant Examiner* — Kyle Grabowski

(57) ABSTRACT

A removable label guest book assembly provides a record of guests attending an event and removable labels to facilitate subsequent communication with those who attended the event. The guest book assembly includes a plurality of pages coupled together forming a book. A plurality of removable labels is coupled to the pages. The labels each have a writing surface configured for being written on by a writing implement. A plurality of recording sheets is provided. Each label has an associated recording sheet positioned between the label and the page. Thus, the recording sheet transfers writing on the writing surface of the label onto the associated page.

1 Claim, 4 Drawing Sheets

REMOVABLE LABEL GUEST BOOK ASSEMBLY

BACKGROUND OF THE DISCLOSURE

Field of the Disclosure

The disclosure relates to guest recording devices and more particularly pertains to a new guest recording device for providing a record of guests attending an event and removable labels to facilitate subsequent mailing to those who attended the event.

SUMMARY OF THE DISCLOSURE

An embodiment of the disclosure meets the needs presented above by generally comprising a plurality of pages coupled together forming a book. A plurality of removable labels is coupled to the pages. The labels each have a writing surface configured for being written on by a writing implement. A plurality of recording sheets is provided. Each label has an associated recording sheet positioned between the label and the page. Thus, the recording sheet transfers writing on the writing surface of the label onto the associated page.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
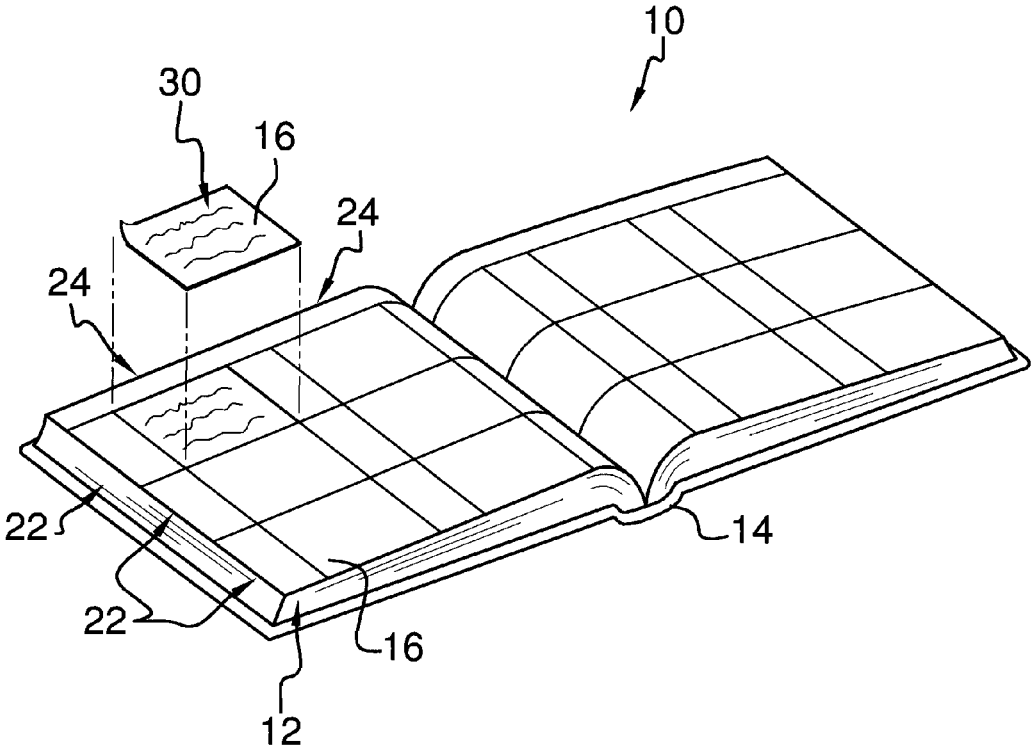
FIG. 1 is a bottom front side perspective view of a removable label guest book assembly according to an embodiment of the disclosure.
Figure 2:
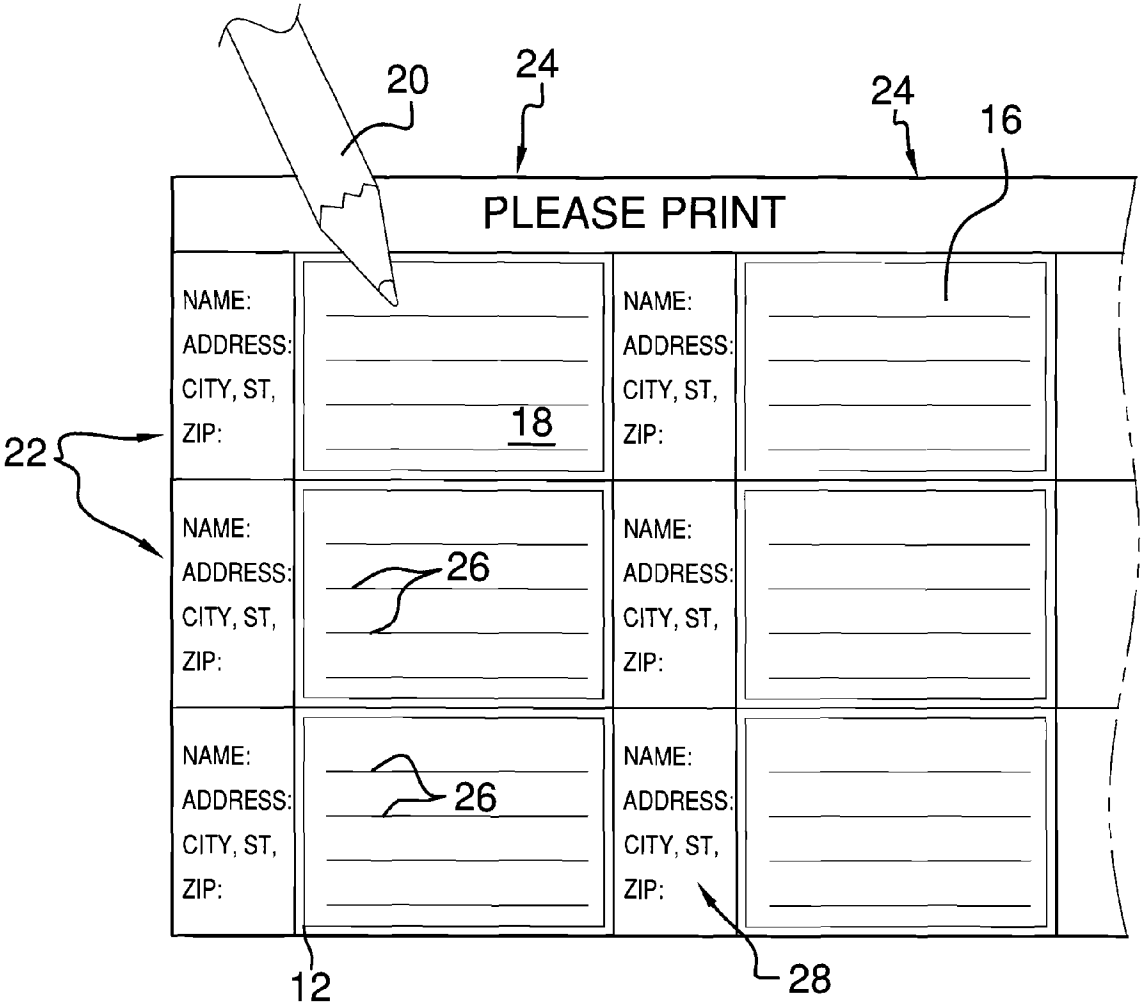
FIG. 2 is a partial front view of an embodiment of the disclosure.
Figure 3:
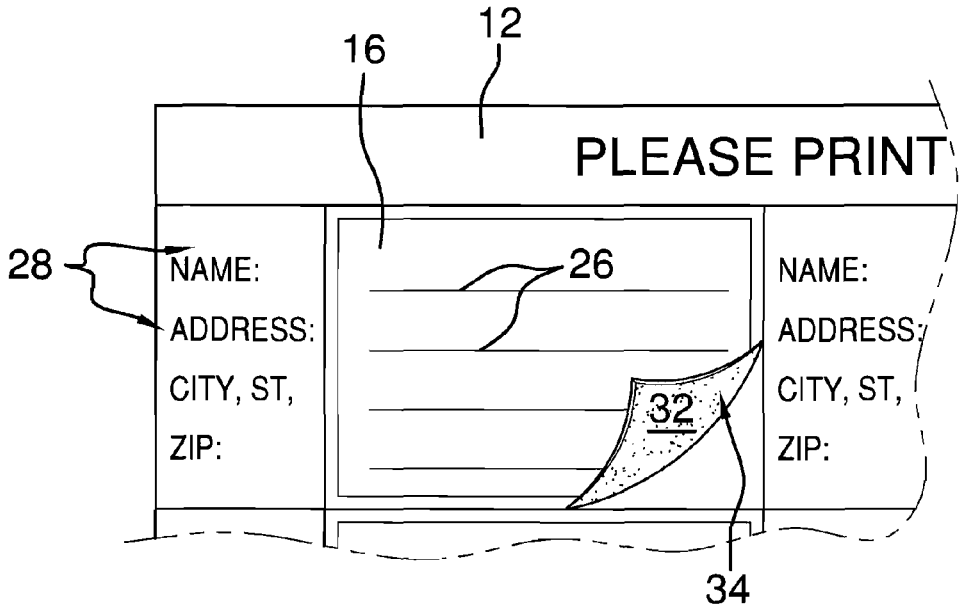
FIG. 3 is a partial front view of an embodiment of the disclosure.
Figure 4:
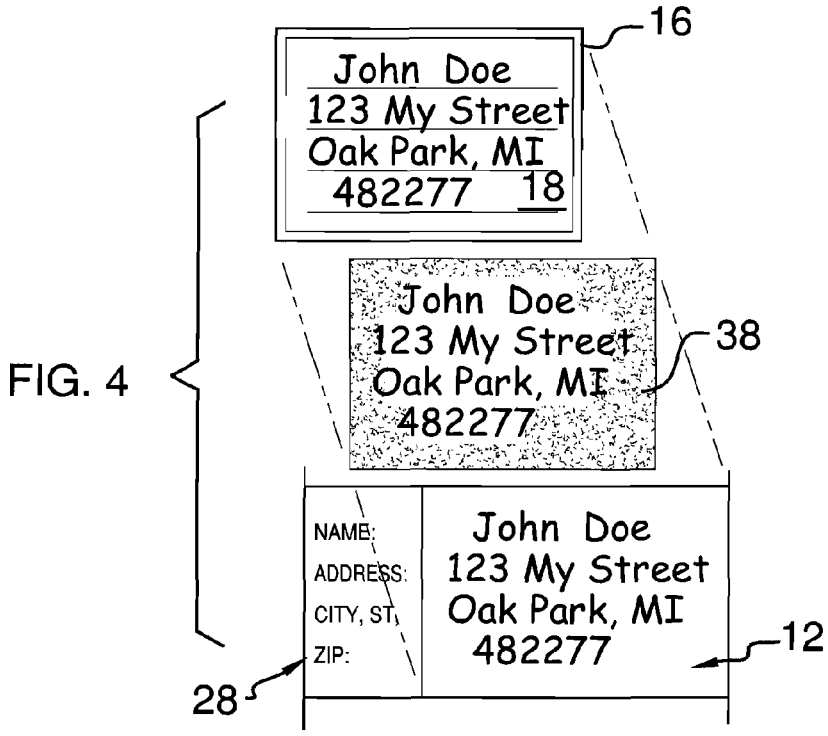
FIG. 4 is a partial front exploded view of an embodiment of the disclosure.
Figure 5:
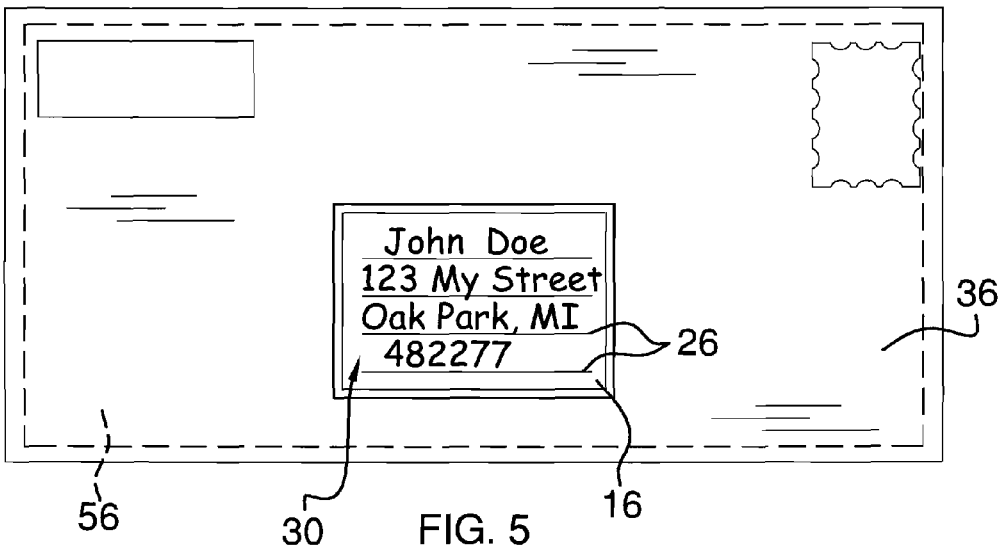
FIG. 5 is an in use front view of an embodiment of the disclosure.
Figure 6:
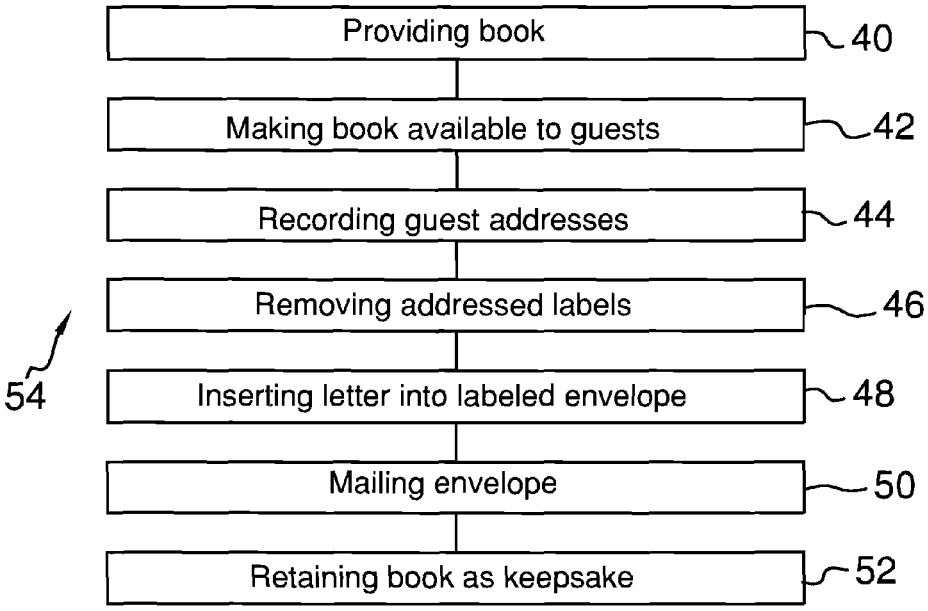
FIG. 6 is a schematic diagram of the steps of a method according to the disclosure.

With reference now to the drawings, and in particular to FIGS. 1 through 6 thereof, a new guest recording device embodying the principles and concepts of an embodiment of the disclosure and generally designated by the reference numeral 10 will be described.

As best illustrated in FIGS. 1 through 6, the removable label guest book assembly 10 generally comprises a plurality of pages 12 coupled together forming a book 14. A plurality of removable labels 16 is provided. Each label 16 is coupled to an associated page 12. The labels 16 have a writing surface 18 configured for being written on by a writing implement 20. The labels 16 are arranged into a plurality of rows 22 on each page 12. The labels 16 may be further arranged into a plurality of columns 24 on each the page 12. Each label 16 includes a plurality of lines 26 on the writing surface 18. Indicia 28 may be positioned adjacent to each label 16 to assist in providing organized and neat recording of each guest's address 30 by indicating address information to be written on each line 26 on the writing surface 18 of the label 16.

An adhesive 32 is coupled to the labels 16 on a back surface 34. The labels 16 are removable from the pages 12 to expose the adhesive 32. Thus, each label 16 is configured for being coupled to an envelope 36 after removal from the page 12.

A plurality of recording sheets 38 of carbon paper may be interposed between the labels 16 and the pages 12. Each label 16 has an associated recording sheet 38 positioned between the label 16 and the page 12 so that the recording sheet 38 transfers writing on the writing surface 18 of the label 16 onto the associated page 12. Alternatively, the label 16 may integrally incorporate the carbon recording sheet 38 or other conventional means of transferring writing on the label 16 to the page 12 beneath the label 16.

In use, the user employs a method 54 of using the invention to record attendees and send thank you letters to those who attended a special event. The first step 40 is providing the book 14 having the pages 12. As indicated above, each page 12 has a removable adhesive label 16 and the book 14 has a recording sheet 38 positioned between each label 16 and the page 12. Thus, writing on each label 16 transfers the writing to the page 12 beneath the label 16. Another step 42 is making the book 14 available to guests at the event. A step 44 of recording guest's addresses on the labels 16 is performed. The user may then perform a step 46 of removing the labels 16 from the page 12 and affixing each label 16 to an associated envelope 36. The user may then take a step 48 of inserting a thank you letter 50 into the associated envelope 36. A penultimate step 50 may be taken by mailing the envelope 36 and then finally, the method 54 may include a step 50 of retaining the book 14 as a keepsake of the event.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A method of facilitating thanking guests attending an event, the steps of the method comprising:

providing a book having a plurality of pages, each page having removable adhesive labels such that said labels are removable from said pages to expose said adhesive, said labels being arranged into a plurality of rows and columns on each said page, said labels having a writing surface with a plurality of lines positioned thereon, said book having a recording sheet made of carbon paper positioned between each said label and said page whereby writing on each said label transfer the writing to said page beneath said label;

making said book available to guests at the event;

recording addresses of the guests addresses on said labels;

removing said labels from said page and affixing each said label to an associated envelope;

inserting a thank you letter into said associated envelope;

mailing said associated envelope; and retaining said book as a keepsake of the event.

* * * * *